US008701210B2

(12) United States Patent
Cheng et al.

(10) Patent No.: US 8,701,210 B2
(45) Date of Patent: Apr. 15, 2014

(54) ADJUSTABLE FEATURE ACCESS FOR A CONTROLLED ENVIRONMENTAL SYSTEM

(75) Inventors: Chung Ming Cheng, Tusuen Wan (HK); Ho Sin Vincent Chan, Heng Fa Chuen (HK)

(73) Assignee: Computime, Ltd., Hong Kong (HK)

( * ) Notice: Subject to any disclaimer, the term of this patent is extended or adjusted under 35 U.S.C. 154(b) by 1655 days.

(21) Appl. No.: 11/865,938

(22) Filed: Oct. 2, 2007

(65) Prior Publication Data

US 2009/0089886 A1 Apr. 2, 2009

(51) Int. Cl.
*G06F 21/86* (2013.01)

(52) U.S. Cl.
USPC ..... 726/34; 713/170; 700/83; 700/276; 700/278; 455/67; 370/329; 380/255; 726/9; 726/27

(58) Field of Classification Search
CPC ..... G06F 21/86; G06F 21/84
USPC ..... 726/34
See application file for complete search history.

(56) References Cited

U.S. PATENT DOCUMENTS

| | | | | |
|---|---|---|---|---|
| 4,274,145 | A * | 6/1981 | Hendricks et al. | 700/278 |
| 5,477,041 | A | 12/1995 | Miron et al. | |
| 5,550,968 | A * | 8/1996 | Miller et al. | 715/741 |
| 5,595,342 | A * | 1/1997 | McNair et al. | 236/51 |
| 6,067,477 | A * | 5/2000 | Wewalaarachchi et al. | 700/83 |
| 6,286,764 | B1 * | 9/2001 | Garvey et al. | 236/12.12 |
| 6,513,723 | B1 * | 2/2003 | Mueller et al. | 236/46 R |
| 6,644,557 | B1 | 11/2003 | Jacobs | |
| 7,003,378 | B2 | 2/2006 | Poth | |
| 7,436,292 | B2 * | 10/2008 | Rourke et al. | 340/505 |
| 7,529,939 | B2 * | 5/2009 | Bruwer | 713/170 |
| 7,624,931 | B2 * | 12/2009 | Chapman et al. | 236/94 |
| 7,744,008 | B2 * | 6/2010 | Chapman et al. | 236/51 |
| 7,784,080 | B2 * | 8/2010 | Renkis | 725/105 |
| 7,877,563 | B2 * | 1/2011 | Breslau et al. | 711/163 |
| 8,083,154 | B2 * | 12/2011 | Schultz et al. | 236/94 |

(Continued)

FOREIGN PATENT DOCUMENTS

| | | | |
|---|---|---|---|
| EP | 1489810 | A2 | 12/2004 |
| JP | 2002-142010 | A | 5/2002 |

OTHER PUBLICATIONS

Transaction Security System|http://ieeexplore.ieee.org/stamp/stamp.jsp?tp=&arnumber=5387472|Abraham et al.|1991|pp. 206-229.*

(Continued)

*Primary Examiner* — Mahfuzur Rahman
(74) *Attorney, Agent, or Firm* — Banner & Witcoff, Ltd.

(57) ABSTRACT

The present invention provides apparatuses and methods for restricting access to a control unit in an environmental system based on a lock level. The control unit (e.g., a thermostat) is configured with a selected lock level, where each lock level is mapped to an associated set of features. A user is able to access any of the features from the associated set of features without entering a security sequence. Also, a feature parameter may be restricted in accordance with the activated lock level. The control unit may be reconfigured with a different lock level by an administrator only when a security sequence is entered. Also, features may be mapped by an administrator to a set of features when the control unit is operating in the locked state. When the control unit is operating in the unlocked state, all supported features can be accessed by a user.

12 Claims, 5 Drawing Sheets

(56) References Cited

U.S. PATENT DOCUMENTS

| | | | | |
|---|---|---|---|---|
| 2003/0216837 | A1* | 11/2003 | Reich et al. | 700/276 |
| 2004/0107358 | A1* | 6/2004 | Shiakallis | 713/200 |
| 2004/0123135 | A1* | 6/2004 | Goddard | 713/200 |
| 2004/0205066 | A1 | 10/2004 | Bhattacharjee et al. | |
| 2005/0028191 | A1* | 2/2005 | Sullivan et al. | 725/28 |
| 2005/0120012 | A1 | 6/2005 | Poth et al. | |
| 2005/0125406 | A1* | 6/2005 | Cina | 707/8 |
| 2006/0069453 | A1* | 3/2006 | DeBourke et al. | 700/19 |
| 2007/0248047 | A1* | 10/2007 | Shorty et al. | 370/329 |
| 2008/0281472 | A1* | 11/2008 | Podgorny et al. | 700/276 |

OTHER PUBLICATIONS

International Search Report for PCT/CN2008/072545, dated Jan. 8, 2009, pp. 1-5.

T7600 Series Non-Programmable Thermostats for Commercial HVAC Applications, Online at: http://www.viconics.com/pdf__files/Thermostats/T7600%20Series/INS-T76NP-E01%20028-0105%20%20INSTALL%20T7600%20NON-PROG.pdf, 2007.

* cited by examiner

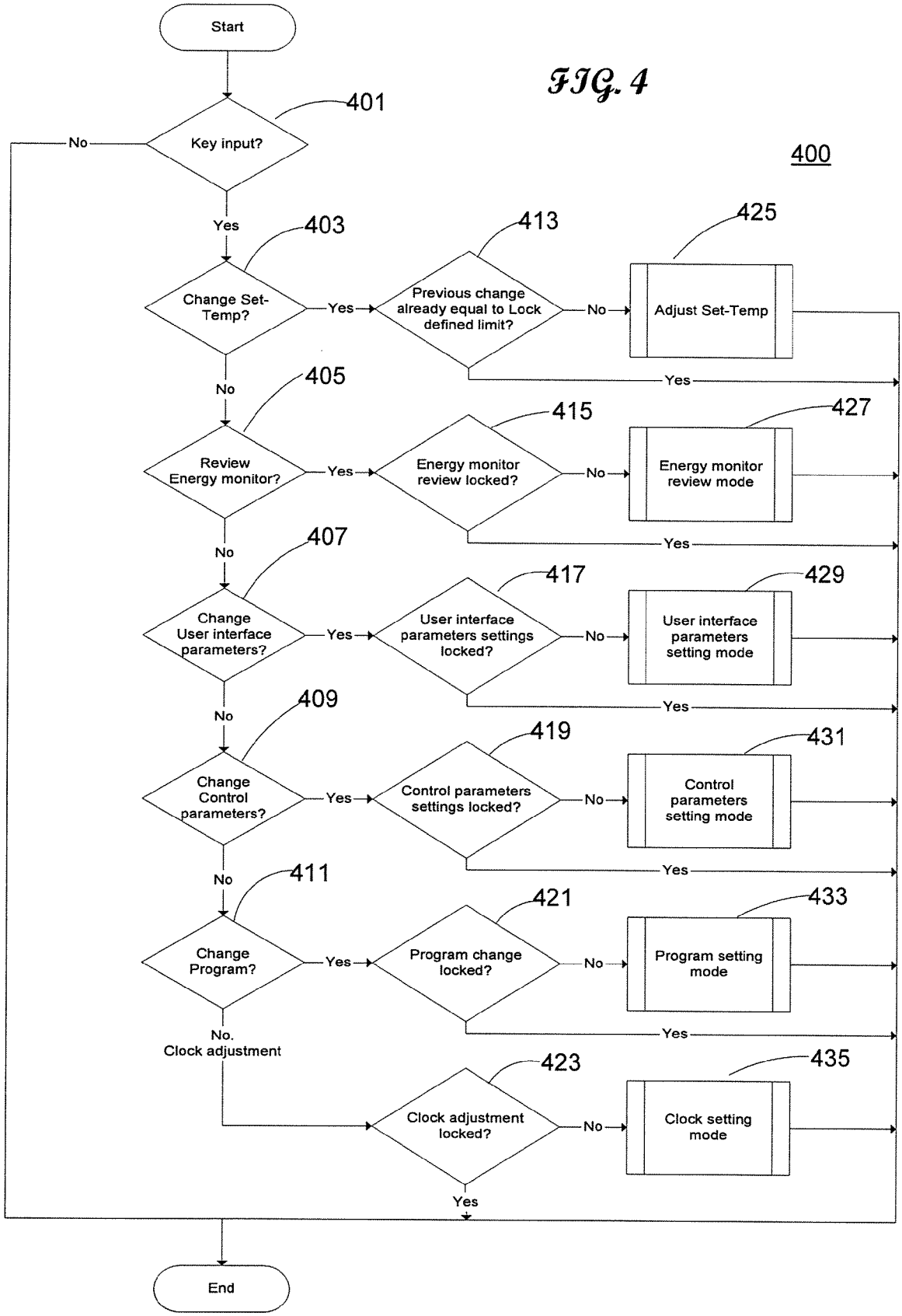
FIG. 4
400
Start
Key input?
401
No
Yes
Change Set-Temp?
403
Yes
Previous change already equal to Lock defined limit?
413
No
Adjust Set-Temp
425
Yes
No
Review Energy monitor?
405
Yes
Energy monitor review locked?
415
No
Energy monitor review mode
427
Yes
No
Change User interface parameters?
407
Yes
User interface parameters settings locked?
417
No
User interface parameters setting mode
429
Yes
No
Change Control parameters?
409
Yes
Control parameters settings locked?
419
No
Control parameters setting mode
431
Yes
No
Change Program?
411
Yes
Program change locked?
421
No
Program setting mode
433
Yes
No.
Clock adjustment
Clock adjustment locked?
423
No
Clock setting mode
435
Yes
End

ADJUSTABLE FEATURE ACCESS FOR A CONTROLLED ENVIRONMENTAL SYSTEM

FIELD OF THE INVENTION

The present invention relates generally to the field of configuring a control unit (e.g., a thermostat) in an environmental system for restricting features based on a lock level.

BACKGROUND OF THE INVENTION

Electronic thermostats often have a keyboard lock feature. By locking the keyboard, keys are consequently not operational. There are several reasons to lock a keyboard. One reason is to prevent the thermostat setup from being changed by unauthorized people. The unlocking procedure is usually unknown to typical users. Another reason is to prevent the thermostat setup form being changed accidentally.

However, locking the keyboard may prevent other people to change the setup of the thermostat. Although this may be the intent of locking the keyboard, doing so may cause inconvenience to people who can properly use the thermostat. One example is the installation in a public area, e.g., an office. The thermostat is programmed to meet the office schedule. After the initial set up, the thermostat is often locked. However, in some scenarios people in the office may want to temporary adjust the room temperature. Consequently, in order to change the setting one may need to ask installation service to have it adjusted.

It is desirable to have a keyboard lock capability that restricts access in order to protect important setup settings but to allow limited adjustment of other settings.

SUMMARY OF THE INVENTION

The present invention provides methods and apparatuses for restricting access to a control unit in an environmental system based on a lock level.

With one aspect of the invention, a control unit (e.g., a thermostat) is configured with a selected lock level from a plurality of supported lock levels. Each lock level is mapped to a set of features, where an associated set of features is mapped to the selected lock level. A user is able to access any of the features from the associated set of features without entering a security sequence.

With another aspect of the invention, a feature parameter is restricted in accordance with the activated lock level.

With another aspect of the invention, a control unit is reconfigured with a different lock level by an administrator only when a security sequence is entered.

With another aspect of the invention, features are mapped to a set of features when the control unit is operating in the locked state. Any feature from the set of features may be subsequently accessed by a general user without a security sequence. When the control unit is operating in the unlocked state, all supported features can be accessed by the general user. The operational state of the control unit may be changed by an administrator by entering a security sequence.

BRIEF DESCRIPTION OF THE DRAWINGS

The foregoing summary of the invention, as well as the following detailed description of exemplary embodiments of the invention, is better understood when read in conjunction with the accompanying drawings, which are included by way of example, and not by way of limitation with regard to the claimed invention.

FIG. 4 shows a flow diagram for keyboard input with a selectable lock level in accordance with an embodiment of the invention.

DETAILED DESCRIPTION OF PREFERRED EMBODIMENTS

Figure 1:
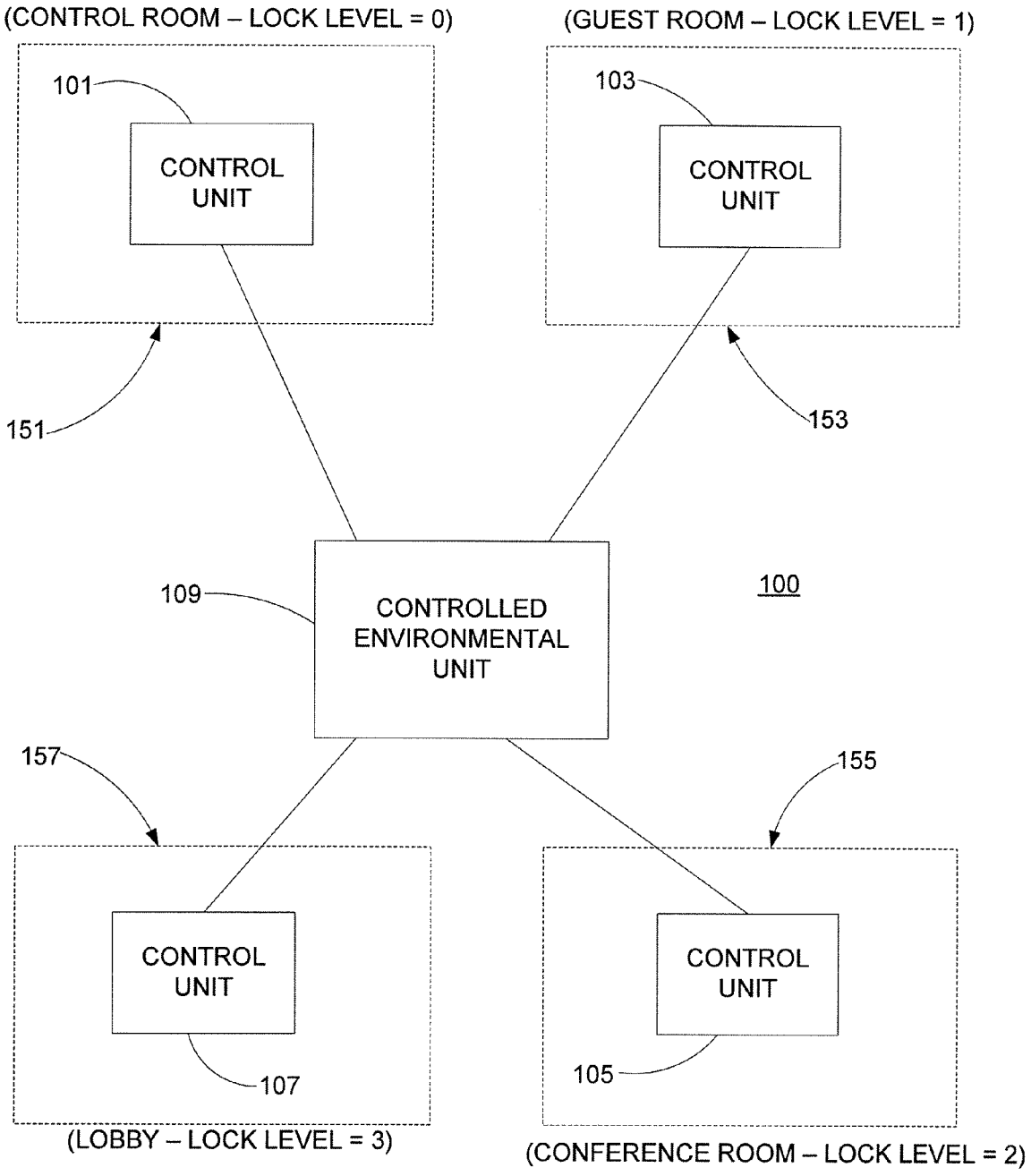
FIG. 1 shows an environmental system in accordance with an embodiment of the invention.

FIG. 1 shows an environmental system 100 in accordance with an embodiment of the invention. Environmental system 100 affects an environmental factor of an environmentally-controlled space (e.g., a room or a portion of a building). Environmental system 100 may affect one or more environmental factors, including temperature, humidity, and air quality. Environmental system 100 may assume different forms, including a heating, ventilation, and air-conditioning (HVAC) unit. A HVAC unit is sometimes referred to as "climate control" and is particularly important in the design of medium to large industrial and office buildings such as sky scrapers and in marine environments such as aquariums, where humidity and temperature must all be closely regulated while maintaining safe and healthy conditions within.

The three functions of heating, ventilation, and air-conditioning are closely interrelated. All the functions seek to provide thermal comfort, acceptable indoor air quality, and reasonable installation, operation, and maintenance costs. HVAC systems can provide ventilation, reduce air infiltration, and maintain pressure relationships between spaces.

Environmental system 100 may be incorporated in a business building or hotel. As exemplified in FIG. 1, environmental system may affect different areas in a hotel, e.g., lobby 157, conference room 155, guest room 153, and control room 151, each room having control units 107-101, respectively, to control the associated area. However, the activity in each area typically varies with the type of space. For example, lobby 157 may have substantial traffic with hotel customers checking in and checking out, visitors, employees, and so forth. Guest room 153 is typically limited to a room occupant, and control room 151 may have access limited to a custodian of the hotel.

While embodiments of the invention support a large scale controlled environment e.g., a business building or hotel as previously discussed, embodiments of the invention support a household programmable thermostat, in which all the functions are packed in a single unit and are accessible to all the users of the house.

With embodiments of the invention, there are only two types of users: an administrator (owner) and general users. The administrator is the person who knows how to set the lock level. Functions accessible by general users depend on the lock level set by the administrator. A general user can access functions permitted by the selected lock state without entering a security sequence, e.g., security code or PIN.

Embodiments of the invention support control units that are associated with different environmental factors, including room temperature (corresponding to thermostats), humidity, and air quality.

The programmable keyboard lock capability, as will be further discussed, enhances a keyboard lock feature in priorart electronic thermostats. (The lock capability refers to limiting access to functions supported by a control unit.) The programmable keyboard lock capability may be implemented as a software implemented feature but may be also implemented by using electronic circuitry. When setting up the keyboard lock, an administrator (e.g., custodian) may also set up a lock level. The lock level determines which functions (features) are available to the users. The number of lock levels and the available functions in each level may be variable, depending on different thermostat designs. It is also possible to provide a feature that the user can select which functions to be locked in a specific lock level.

The programmable keyboard lock capability limits access to the functions of the thermostat.) For example, a programmable thermostat may support the following features (functions):

Feature 2: A set of user defined programs to tell the thermostat how to change the set-temp.

Feature 3: A clock act as time reference of the programs.

Feature 4: A program override function to temporary change the set-point from the program temperature.

Feature 5: An energy monitor to record the operating history of the system.

Feature 6: Control parameters, such as switching span, temperature calibration, fan control logic, heating and cooling that set the control method of the thermostat.

Feature 7: User interface parameters, such as time display format (AM/PM or 24 hours), temperature scale (Fahrenheit or Celsius), keyboard sound feedback that set the thermostat to suit the users' need.

For example, the programmable keyboard lock may specify several lock levels. The higher the lock level, the smaller the number of functions available to a user (person other than an administrator). In a hotel environment, for example, a user may include a room guest, visitor, or non-custodian employee. The administrator may select the appropriate lock level for the thermostat.

TABLE 1

MAPPING OF FEATURES TO LOCK LEVELS

| Lock Level | Details |
|---|---|
| 0 | Unlocked: All thermostat functions are available. i.e., no keyboard lock is set. |
| 1 | Functions available:<br>feature 4: Temporary program override is available but set-temp adjustment is limited to +/−5° F.<br>feature 5: Energy Monitor is available.<br>feature 7: User interface parameter can be changed.<br>Functions locked:<br>feature 2: Change of Program setting.<br>feature 3: Change of Clock setting.<br>feature 6: Change of Control parameter setting. |
| 2 | Functions available:<br>feature 4: Temporary program override is available but set-temp adjustment is limited to +/−3° F.<br>feature 5: Energy Monitor is available.<br>Functions locked:<br>feature 7: Change of User interface parameter<br>feature 2: Change of Program setting.<br>feature 3: Change of Clock setting.<br>feature 6: Change of Control parameter setting. |
| 3 | All thermostat functions are locked. |

As shown in Table 1, a first set of features (features 4, 5 and 7) is associated with lock level=1. A second set of features (features 4 and 5) is associated with lock level=2. When lock level=0, all features are available (unlocked), while all features are locked when lock level=3.

With the embodiments of the invention, a control unit (e.g., a thermostat) is preset with several lock levels in the factory (e.g., unlock, levels 1, 2 and 3). Only one lock level is active at any time. Embodiments of the invention may alternatively map different features to different lock levels (two or more levels) with programming by the administrator. For example, as will be discussed, the administrator can select (map) different features to a locked state while all features are accessible to a general user in the unlocked state.

Figure 5:
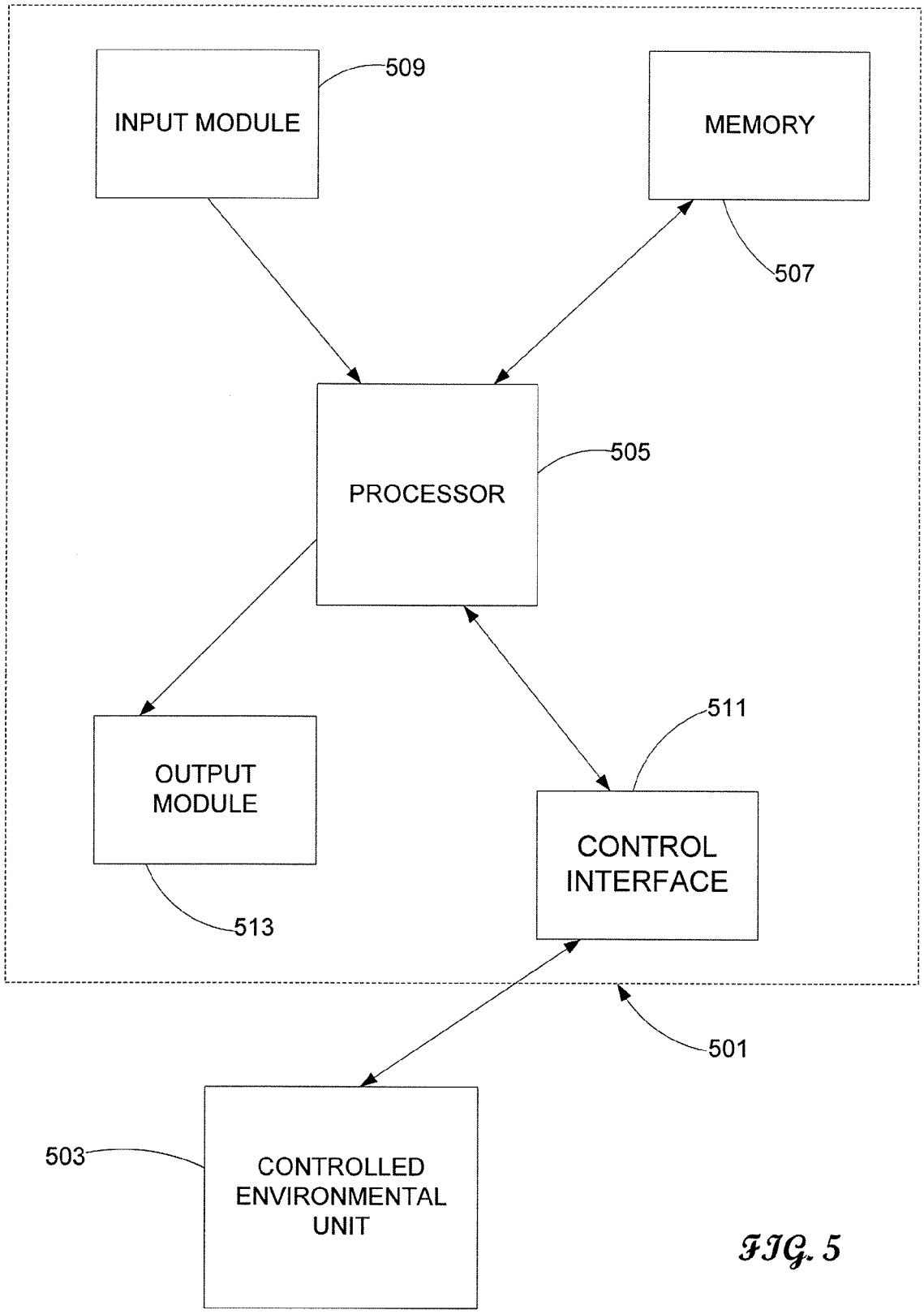
FIG. 5 shows an architecture of a control unit in accordance with an embodiment of the invention.

According to embodiments of the invention, a programmable thermostat has a user interface that includes a display (e.g., output module 513 as shown in FIG. 5) and an input device (e.g., input module 509). The display is typically an LCD that displays information and operation status of the thermostat. The input device usually includes several keys, switches and even knobs that can be adjusted. The keyboard refers to any of the above input interfaces. Through the keyboard and with the aid of the display, the administrator can change the settings of the thermostat to meet desired requirements.

A thermostat may span an area that is occupied by many people. Some of them may not be able to use the thermostat properly. For example, the kids in a family may see the thermostat as a toy. Another situation corresponds to the thermostat being installed in a public area such as an office or a classroom. The responsible person of the area may not want other people to have full access to the thermostat, even though they know how to use it properly. For these reasons many thermostats are equipped with a keyboard lock capability. When locked, the keyboard is disabled so the user is totally restricted from changing the setting of the thermostats. The user has to unlock the keyboard in order to gain further access of the thermostat functions.

Prior art thermostat may encounter several deficiencies. In the above examples, for example, the parents will have to carry out the unlock—change—lock procedure to change a temperature. This makes an originally simple task troublesome. People in an office or a classroom may find it uncomfortable to have the thermostat set to a fixed temperature. With embodiments of the invention, the programmable keyboard lock capability is an improvement of the prior art keyboard lock capability. Instead of totally eliminating the keyboard function, the programmable keyboard lock capability allows the owner (administrator) of the control unit (e.g., thermostat) to determine which functions are accessible by general users (other than administrator), while restricting the users from changing some critical setting.

Figure 2:
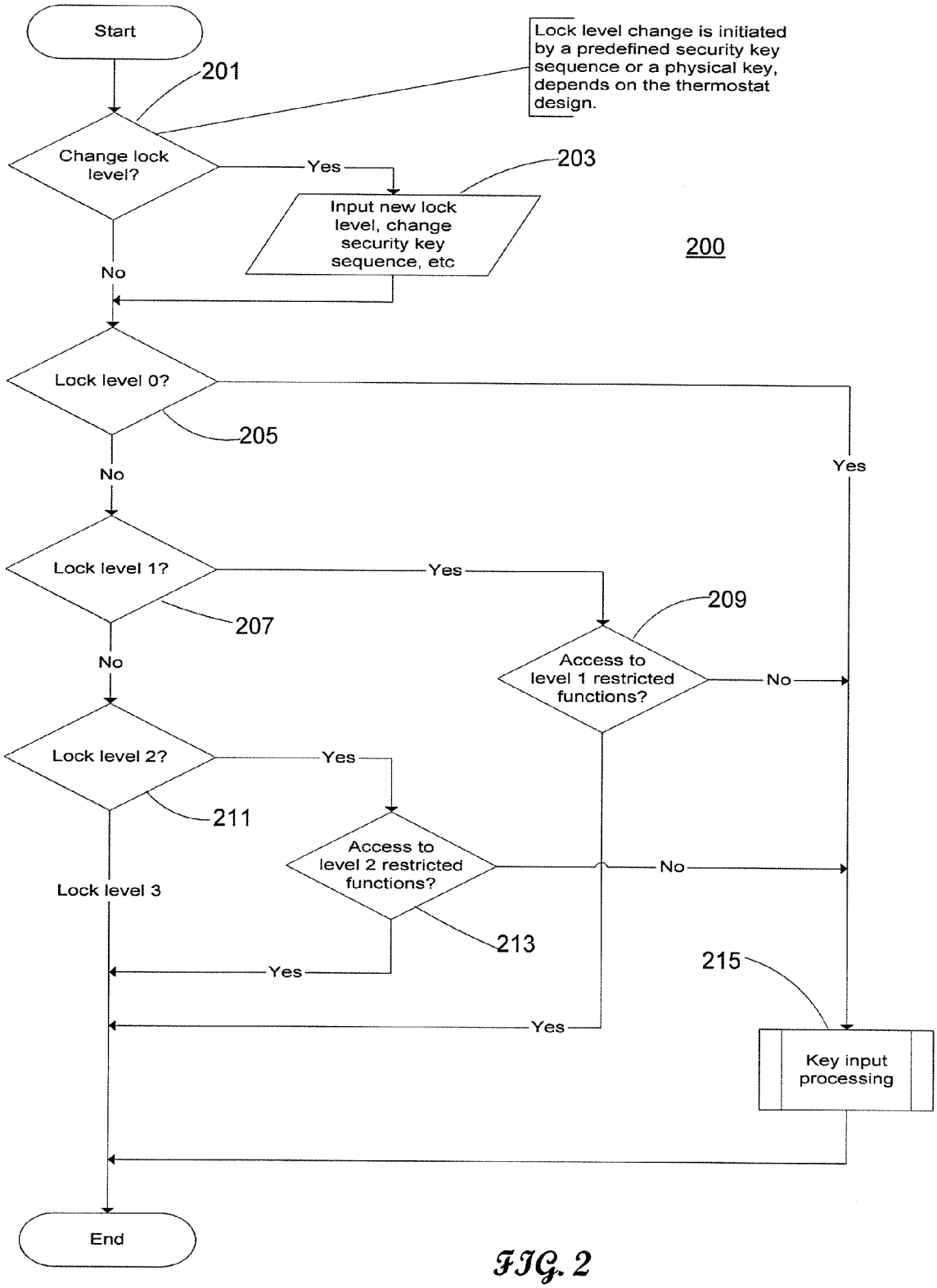
FIG. 2 shows a flow diagram for processing an input in accordance with an embodiment of the invention.

FIG. 2 shows flow diagram 200 for processing a keyboard input (typically comprising keystrokes) in accordance with an embodiment of the invention and illustrates an example of the key handling process with adjustable keyboard lock for a thermostat that supports the programmable keyboard lock capability. With embodiments of the invention, a control unit is preset with several lock levels in the factory (e.g., lock level 0, lock level 1, lock level 2, and lock level 3).

Step 201 determines if an administrator desires to change the lock level configured for the control device. (Embodiments of the invention may configure the control unit with only one security level, e.g., lock level equal to 3 for lobby 157 as shown in FIG. 1 or for a home.). In such a case, if the administrator configures another lock level, the previous lock level is removed. In step 203, the administrator (owner) of the control unit locks, unlocks, or changes the lock level of keyboard by entering a security sequence, e.g., security code or PIN, in which the administrator knows how to set, while the general users don't know.

Steps 205-215 correspond to subsequent keyboard entry by a general user after the administrator has configured the control unit in steps 201-203 for a selected lock level. (With embodiments of the invention, a general user can access features associated (mapped) with the selected lock level without entering a security sequence.) Steps 205, 207, and 211 determine the selected lock level as configured by the administrator. (With the exemplary embodiment, the control unit may be configured as lock level 0, lock level 1, lock level 2, or lock level 3 as shown in Table 1.) If step 205 determines that the selected lock level is equal to lock level 0, all features are available to the general user. If so, key input processing 215 processes the entered keystrokes. If the selected lock level is not equal to lock level 0, then step 207 determines if the selected lock level is equal to lock level 1. If so, step 209 checks the entered keystrokes to determine whether the requested feature is associated with the lock level 1. If the requested feature is restricted (i.e., not available for lock level 1), then process 200 is terminated. Otherwise, key input processing 215 processes the entered keystrokes.

If the selected lock level is not equal to lock level 1, then step 211 determines if the selected lock level is equal to lock level 2. If so, step 213 checks the entered keystrokes to determine whether the requested feature is associated with the lock level 2. If the requested feature is restricted (i.e., not available for lock level 2), then process 200 is terminated. Otherwise, key input processing 215 processes the entered keystrokes. If step 211 determines that the selected lock level is equal to lock level 3, then process 200 is terminated because the general user cannot access any supported feature.

Lock and unlocking or changing the lock level can be done by entering (inputting) a security sequence e.g., a predefined key sequence, a password, or a physical key as determined by step 203. The predefined security sequence depends on the design and application of the thermostat. If the thermostat is intended to be installed in a home, a simple lock—unlock procedure (e.g., pressing several keys together for 3 seconds) is typically all that is needed. For control units that are installed in public places, a password or even a physical key may be required for security.

Figure 3:
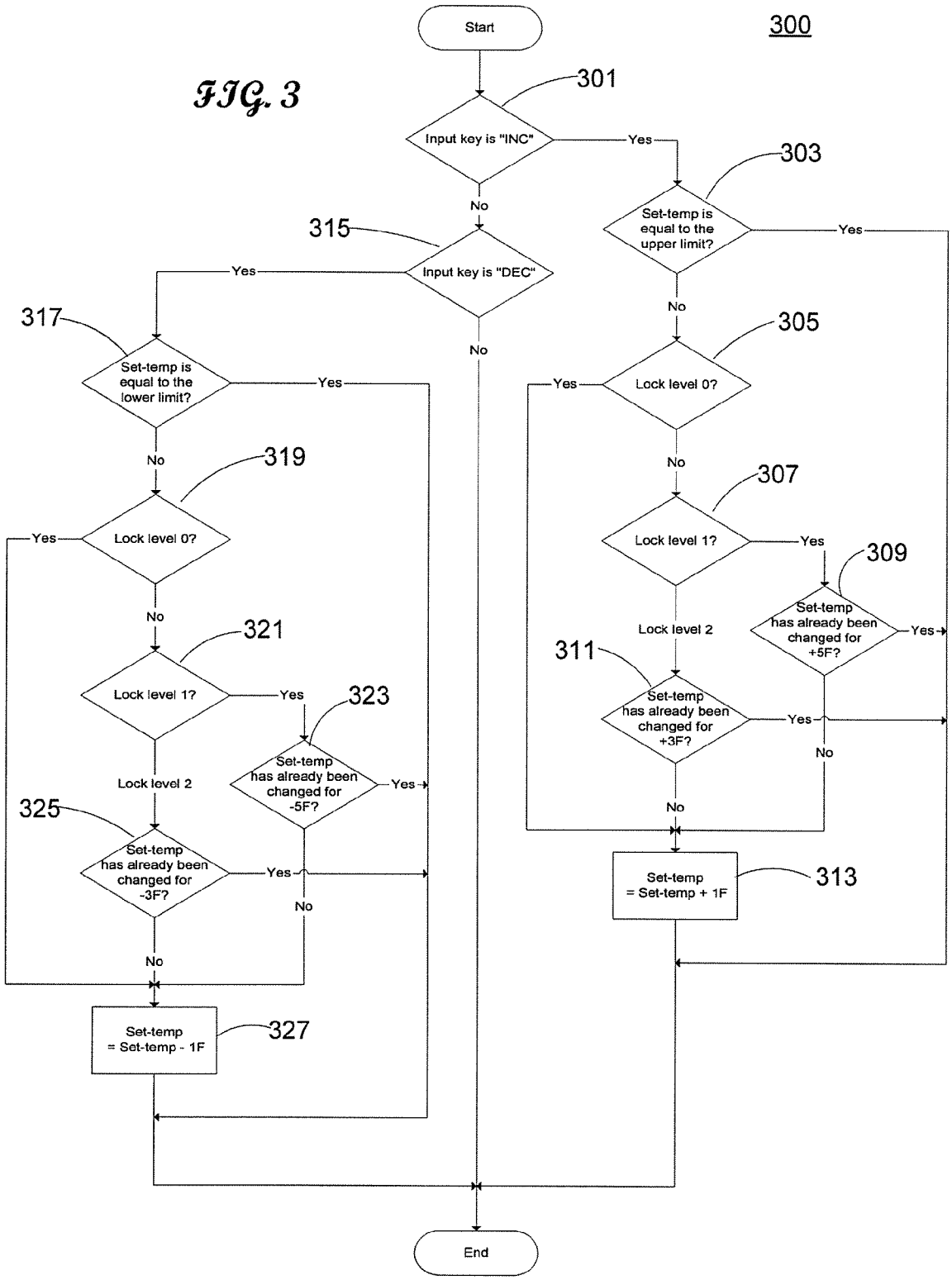
FIG. 3 shows a flow diagram for inputting a value of a feature parameter in accordance with an embodiment of the invention.

FIG. 3 shows flow diagram 300 for inputting a value of a feature parameter in accordance with an embodiment of the invention. Some thermostat features may not be totally restricted when the keyboard lock is set and may have functionality limited. For example, with the above-discussed thermostat the temperature setting range (which is denoted as a feature parameter) is limited to +/−5° F. when the lock level equals 1 and further reduced to +/−3° F. when the lock level equals 2. Processing for feature 4 (Temporary program override is available but set-temp adjustment is limited to +/−5° F.) considers the lock level when processing the key inputs.

Flow diagram 300 processes inputs from the keyboard for configuring the temperature set points in accordance with the lock level. If a user inputs a keyboard sequence indicative of increasing the temperature set point (step 301), steps 303-313 are executed. As with the exemplary embodiment as shown in FIG. 2, a general user is not required to enter a security sequence. If the user inputs a keyboard sequence indicative of decreasing the temperature set point (step 315), steps 317-327 are executed.

With embodiments of the invention, the programmable keyboard lock capability of a control unit does not have selectable lock level. However, with embodiments of the invention the control unit may operate in one of two operating states: a locked state and an unlocked state. The capability enables the administrator to select (program) which function is locked when the keyboard lock is activated. As shown in Table 2, one or more features (features 1-6) may be mapped to the locked state. For an example, the administrator may select feature 1 (temporary program override set-temp adjustment) and feature 4 (control parameter setting) when the control unit (e.g., thermostat) is in the locked state. When the locked state is activated, a user can access only the selected features.

TABLE 2

PROGRAMMING FEATURES TO THE LOCK STATE

| Lock Setting | Details |
|---|---|
| Unlocked State | All thermostat functions are available. i.e., no keyboard lock is set. |
| Locked State | feature 1: Temporary program override set-temp adjustment limited: 0 to +/−5° F. (may allow the administrator to set the adjustment range)<br>feature 2: Energy Monitor: Enable or Disable.<br>feature 3: User interface parameter changeable: Enable or Disable.<br>feature 4: Control parameter setting changeable: Enable or Disable.<br>feature 5: Program setting changeable: Enable or Disable.<br>feature 6: Clock setting changeable: Enable or Disable. |

FIG. 4 shows flow diagram 400 for keyboard input with a selectable lock level in accordance with an embodiment of the invention. Processing by flow diagram 400 parallels Table 2. In step 401, input from the keyboard is obtained. In steps 403-411, the keyboard input (which corresponds to one or more entered keystrokes) are associated with thermostat functions (features 1-6 as shown in Table 2.) After associating the entered keystrokes with a particular feature, steps 413-423 determines the particular feature being requested FIG. 5 shows an architecture of control unit 501 in accordance with an embodiment of the invention. Control unit 501 controls environmental controlled unit 503 through control interface 511. Processor 505 accesses memory 507 in order to execute computer-executable instructions to perform processes supporting the programmable keyboard lock capability.

An administrator inputs a keyboard sequence to configure control unit 501, and a user (non-administrator) enters inputs sequences (a general user does not need to enter input sequence/password) to access features for configured lock levels through input module 509.

Processor 505 may display control information, e.g., the temperature set points and the measured room temperature, on output module 513. Also, processor 505 may display an indication if the user is attempting to access a feature that is restricted to the configured (selected) lock level.

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for restricting access to a control unit in an environmental system, comprising identifying, by a processor, a selected lock level from a plurality of supported lock levels, wherein each supported lock level determines a corresponding set of features that are available to a user;

configuring, by the processor, the control unit with the selected lock level, wherein only one lock level assigned to the control unit is activated at a time instance to restrict access to the control unit;

when the selected lock level equals a first lock level, enabling a first set of features for the control unit, wherein at least one feature of the first set of features affects at least one of a controlled space temperature, a controlled space humidity, and a controlled space humidity;

when the selected lock level equals a second lock level, enabling a second set of features for the control unit;

when the selected lock level equals the first lock level, restricting a feature parameter within a first value;

when the selected lock level equals the second lock level, restricting the feature parameter within a second value;

reconfiguring the control unit with the different lock level only when a security sequence is entered; and accessing one of the first set of features when the selected lock level equals the first lock level without entering a security code.

2. The method of claim 1, further comprising:

accessing one of the second set of features when the selected lock level equals the second lock level.

3. The method of claim 1, further comprising:

programming the first set of features to include at least one feature.

4. The method of claim 1, further comprising:

restricting an entered control parameter when the selected lock level equals the first lock level.

5. The method of claim 1, further comprising:

configuring another control unit in the environmental system with a different lock level.

6. A method for restricting access to a control unit in an environmental system, comprising:

mapping, through a memory device by a processor, a feature to a set of features when the control unit is operating in a locked state that is assigned to the control unit to restrict access to the control unit, the set of features being a subset of all supported features, the set of features being available to a user of the environmental system, wherein at least one feature of the set of features affects at least one of a controlled space temperature, a controlled space humidity, and a controlled space humidity;

accessing, through the memory device, by the processor, one of the set of features without entering a security sequence;

when a selected lock level equals a first lock level, restricting a feature parameter within a first value;

when the selected lock level equals a second lock level, restricting the feature parameter within a second value;

identifying a different lock level; and reconfiguring the control unit with the different lock level only when the security sequence is entered.

7. The method of claim 6, further comprising:

accessing any of all said supported features when the control unit is operating in an unlocked state.

8. The method of claim 6, further comprising:

modifying the set of features only if the security sequence is entered.

9. The method of claim 7, further comprising:

reconfiguring an operating state of the control unit only when the security sequence is entered.

10. An apparatus for controlling an environmental system comprising:

a control interface;

an input module;

a processor configured to perform:

identifying a selected lock level from a plurality of supported lock levels;

configuring the apparatus with the selected lock level, wherein only one lock level is activated at a time instance and wherein a set of features is mapped to the selected lock level assigned to the apparatus to restrict access to the apparatus, wherein the set of features are available to a user of the apparatus, and wherein at least one feature of the set of features affects at least one of a controlled space temperature, a controlled space humidity, and a controlled space humidity;

obtaining at least one keystroke from the input module;

determining a feature associated with the at least one keystroke;

instructing the environmental system to operate in accordance with a feature only when the feature is mapped to the feature;

accessing one of the set of features without entering a security sequence;

when the selected lock level equals a first lock level, restricting a feature parameter within a first value;

when the selected lock level equals a second lock level, restricting the feature parameter within a second value;

identifying a different lock level; and reconfiguring the control unit with the different lock level only when a security sequence is entered.

11. The apparatus of claim 10, the processor further configured to perform:

accessing one of a first set of features when the selected lock level equals the first lock level without entering a security code.

12. The apparatus of claim 10, the processor further configured to perform:

programming the set of features to include at least one feature.

* * * * *